US006174038B1

(12) United States Patent
Nakazawa et al.

(10) Patent No.: US 6,174,038 B1
(45) **Date of Patent: *Jan. 16, 2001**

(54) INK JET PRINTER AND DRIVE METHOD THEREFOR

(75) Inventors: Chiyoshige Nakazawa; Masahiro Minowa; Naoki Kobayashi, all of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/952,192

(22) PCT Filed: Mar. 6, 1997

(86) PCT No.: PCT/JP97/00697

§ 371 Date: Mar. 23, 1998

§ 102(e) Date: Mar. 23, 1998

(87) PCT Pub. No.: WO97/32728

PCT Pub. Date: Sep. 12, 1997

(30) Foreign Application Priority Data

Mar. 7, 1996 (JP) ..... 8-050631
Mar. 7, 1996 (JP) ..... 8-050632

(51) Int. Cl.[7] ..... B41J 29/38
(52) U.S. Cl. ..... 347/10
(58) Field of Search ..... 347/10, 17, 54, 347/13

(56) References Cited

U.S. PATENT DOCUMENTS 5,172,134 12/1992 Kishida et al. .
5,204,695 * 4/1993 Tokunaga et al. ..... 347/11
5,281,980 * 1/1994 Kishida et al. ..... 347/13
5,541,628 7/1996 Chang et al. .
5,563,634 10/1996 Fujii et al. .
5,644,341 7/1997 Fujii et al. .

FOREIGN PATENT DOCUMENTS 0 634 272 1/1995 (EP) .
2 272 185 5/1994 (GB) .
56-129177 10/1981 (JP) .
60-154075 8/1985 (JP) .
61-59911 3/1986 (JP) .
2-51734 2/1990 (JP) .
2-217256 8/1990 (JP) .
3-15556 1/1991 (JP) .
3-234650 10/1991 (JP) .
6-39163 2/1994 (JP) .
7-81088 3/1995 (JP) .
7-137252 5/1995 (JP) .
7-246703 9/1995 (JP) .

* cited by examiner

*Primary Examiner*—John Barlow
*Assistant Examiner*—Charles W. Stewart, Jr.

(57) ABSTRACT

In an ink jet printer having pressure generate means for pressurizing ink inside the printer nozzles, either a first electric pulse of an amplitude enabling ink drop ejecting, or a second electric pulse of an amplitude lower than the amplitude of the first electric pulse for mobilizing ink inside a nozzle, is applied to each pressure generator synchronized to a reference signal of a single frequency. An ink drop is not ejected when a low amplitude second pulse is applied to a pressure generating means. Applying said second electric pulse instead stimulates ink around the nozzle so that high viscosity ink at the nozzle tip mixes with low viscosity ink deeper inside the nozzle, thereby lowering the overall viscosity of ink in the nozzle so that ink drop ejecting is easier.

23 Claims, 13 Drawing Sheets

| State | [1] | [2] | [3] |
|---|---|---|---|
| timing pulse Tp | H | L | H |
| data signal Dx | H | H/L | L |
| common electrode terminal 22 | V1 | GND | V1 |
| segment electrode 10x | GND | GND | V2 |
| diaphragm displacement | 8, 10b | 8, 10b, 10a | 8, 10b, 10a |

| State | [ 1 ] | [ 2 ] | [ 3 ] |
|---|---|---|---|
| timing pulse Tp | H | L | H |
| data signal Dx | H | H/L | L |
| common electrode terminal 22 | V1 | GND | V1 |
| segment electrode 10x | GND | GND | V2 |
| diaphragm displacement |   |   |   |

INK JET PRINTER AND DRIVE METHOD THEREFOR

FIELD OF THE INVENTION

The present invention relates to an ink jet printer for recording text, symbols, images, and other printing data by ejecting minute ink drops, and relates particularly to a control method for an ink jet printer whereby clogging of nozzles by ink that has become more viscous in the area of the nozzles is prevented.

RELATED TECHNOLOGY

Various methods of driving the nozzles of an ink jet recording device to eject recording ink from the nozzles have been disclosed and are today used on such ink jet recording devices. These methods include using a piezoelectric element as the driving means as taught in Japan Examined Patent Publication (kokoku) 2-51734 (1990-51734); ejecting ink using a heating element for heating the ink as disclosed in Japan Examined Patent Publication (kokoku) 61-59911 (1986-59911); and ejecting ink from the nozzles by using an electrostatic actuator to vibrate a diaphragm by means of electrostatic force as disclosed in Japanese Patent Application (Tokkai) 7-81088.

Generally speaking, such ink jet printers buffer an image signal to RAM or other storage devices, and then selectively drive the appropriate pressure generating means, i.e., piezoelectric element, heating element, or electrostatic actuator, disposed near each nozzle to eject ink and print to a recording medium based on the buffered image signal data.

A problem common to each of these ink jet printer designs is that when ink is not ejected from the nozzles for a certain period of time, ink around the nozzles tends to dry due to evaporation of moisture or other ink solvent. This results in increased viscosity in ink near the nozzles.

When the viscosity of ink near the nozzles thus rises, the nozzles tend to clog, thus completely preventing ink from being ejected during printing, or preventing ink from being ejected at the normal dot size and speed. This increased ink viscosity can also slow the refill rate of ink to the nozzles, thereby preventing the nozzles from being refilled at the same rate ink is ejected. Air can become mixed with the ink when this happens, thus preventing ink drops from being ejected.

To avoid the above problems, many ink jet printers cover the nozzles with a cap when printing (recording) is not in progress. This prevents the nozzles from drying, and prevents an increase in the viscosity of ink around the nozzles.

In addition to such methods of covering the nozzles with a cap, many methods of preventing ink blockage near the nozzles by regularly ejecting microdrops of ink from all nozzles separately from the printing process have also been proposed. These methods also help maintain and recover printing performance.

Exemplary of these methods is the recovery process method disclosed in Japan Examined Patent Publication (kokoku) 6-39163 (1994-39163) for reliably expelling high viscosity ink without introducing air to the nozzles even when the viscosity of ink around the nozzles rises. This is accomplished by setting the ink jet head drive frequency used during the recovery ejection operation lower than the highest drive frequency used when recording text or images.

Methods other than expelling high viscosity ink to recover the nozzles have also been disclosed. Exemplary of these is the method disclosed in Japan Unexamined Patent Publication (kokai) 56-129177 (1981-129177) for preventing nozzle clogging due to dry ink around the nozzles by using an oscillator to vibrate the ink at the resonance frequency of the ink jet head and mobilize the ink when recording is not in progress.

The various methods described above, however, leave the following problems unresolved.

(1) Each of the above methods requires two drive frequencies, a recording frequency for ejecting ink drops during recording, and a nozzle recovery frequency for driving a pressure generating means to prevent clogging, and these two frequencies must be used appropriately. The drive circuit and control thereof are thus complex.

(2) When an ink jet head having high viscosity ink around the nozzles is driven at a frequency lower than a drive frequency used during normal recording as taught in Japan Examined Patent Publication (kokoku) 6-39163 (1994-39163), it can be difficult to expel high viscosity ink in ink jet heads in which the pressure generated by the pressure generating means is itself low. This method therefore cannot be used with all types of ink jet printers.

(3) The viscosity also rises throughout the upstream ink path leading to the nozzles, and not just around the nozzles, after a certain amount of time has passed even if the ink is mobilized by vibrating the ink at the resonance frequency of the ink jet head when recording is not in progress as taught in Japan Unexamined Patent Publication (kokai) 56-129177 (1981-129177). Ink ejecting thus eventually becomes impossible. As a result, this method cannot be used for applications in which normal ink jet recording is not performed for a certain period of time, i.e., a no-ejection condition continues for a certain period of time.

(4) When recording is not in progress the ink viscosity increases around all of the nozzles. During recording, however, fresh ink is constantly supplied to frequently used nozzles and the ink viscosity at those nozzles is therefore low while the ink viscosity around less frequently used nozzles increases. This means that both high viscosity and low viscosity nozzles can be found in the same ink jet head during recording. While the less frequently used nozzles could be maintained by frequent maintenance (recovery) ejecting therefrom, this necessitates analyzing the recording data to determine the no-ejection time for each nozzle. This, however, is difficult to accomplish for each of the more than one-hundred or so nozzles on an ink jet head. A method whereby all nozzles are regularly operated for nozzle recovery is therefore used on the assumption that none of the nozzles has ejected once since the last operation. This method, however, results in the wasteful consumption of ink by frequently used nozzles, nozzles for which such nozzle recovery ejecting is not necessary.

An object of the present invention is therefore to provide an ink jet printer whereby nozzle clogging can be reliably prevented by means of a simple method and construction, thereby resolving the above problems.

A further object of the present invention is to reduce the amount of ink consumed by the recovery process for preventing nozzle clogging.

SUMMARY OF THE INVENTION

To achieve the above objects, a drive method for an ink jet printer comprising a plurality of nozzles for ejecting ink drops, pressure generating means disposed corresponding to said nozzles for pressurizing ink in said nozzles, and a means for transporting said nozzles relative to a printing medium for printing, generates a reference signal of a single frequency, and applies to each pressure generating means of the ink jet printer synchronized to the reference signal one of the following: a first electric pulse of an amplitude enabling ink drop ejecting, and a second electric pulse of an amplitude lower than the amplitude of the first electric pulse for mobilizing ink inside a nozzle.

In addition, an ink jet printer having a plurality of nozzles for ejecting ink drops, pressure generating means disposed corresponding to said nozzles for pressurizing ink in said nozzles, and a means for transporting said nozzles relative to a printing medium for printing, comprises a reference signal generation means for generating a reference signal of a single frequency, and a drive means for applying to each pressure generating means synchronized to the reference signal one of the following: a first electric pulse of an amplitude enabling ink drop ejecting, and a second electric pulse of an amplitude lower than the amplitude of the first electric pulse for mobilizing ink inside a nozzle.

An ink drop is ejected from a nozzle for recording to a recording medium when a first electric pulse is applied to a pressure generating means. Recording to a recording medium can thus be accomplished by selectively applying the first electric pulse in a printing process according to the printing content.

The first electric pulse is also used in a nozzle recovery process for preventing nozzle clogging by ejecting ink drops from all nozzles.

When a second electric pulse of an amplitude lower than the amplitude of the first electric pulse is applied to a pressure generating means, an ink drop is not ejected. Applying the second electric pulse mobilizes ink near the nozzle, thereby stimulating ink around the nozzle so that high viscosity ink at the nozzle tip mixes with low viscosity ink deeper inside the nozzle. This lowers the overall viscosity of ink in the nozzle so that ink drop ejecting is easier.

The second electric pulse and first electric pulse are applied selectively to pressure generating means synchronized to the same reference signal. Circuit configuration is thus simplified because a plurality of frequencies is not required, and control is therefore simple.

The second electric pulse is used as follows in a nozzle recovery process for preventing nozzle clogging. Specifically, the second electric pulse is applied a plurality of times to a pressure generating means, and the first electric pulse is then applied. Applying the second electric pulse mobilizes ink in which there are localized increases in viscosity, notably near the nozzle. Mobilization thus lowers the viscosity of ink near the nozzle, and the first electric pulse is then applied to eject an ink drop from the nozzle. This sequence enables reliable ink ejecting and nozzle recovery even in ink jet printers in which the pressure generated by the pressure generating means is low.

When a recovery process unit comprises applying the second electric pulse a plurality of times followed by applying the first electric pulse, it is also possible to perform a recovery process unit two or more times consecutively.

The nozzle recovery process can be performed in a serial ink jet printer that prints while moving the nozzles in a shift direction at each printed line, or after a print command is received and before a printing process based on the received print command. The nozzle recovery process can also be performed at a regular interval during printer standby states, or appropriately according to conditions.

The second electric pulse is used as follows during a printing process.

Specifically, a first electric pulse is applied selectively to pressure generating means according to the printing content to eject ink drops from one or more nozzles, and the second electric pulse is applied to those nozzles to which the first electric pulse is not applied. This suppresses an increase in the viscosity of ink in less frequently used nozzles. More specifically, this reduces differences in ink viscosity resulting from differences in the frequency of nozzle use in the same ink jet head. It is therefore possible to increase the interval between nozzle recovery ejection operations, and thereby decrease wasteful ink consumption from the nozzle recovery process. This method is particularly effective in color ink jet printers where differences in the frequency of nozzle use occur easily.

The method of the present invention can be used in any ink jet printer using pressure generating means whereby ink drops can be ejected, or ink inside a nozzle can be mobilized without ejecting an ink drop, by changing the amplitude of the drive pulse applied to a pressure generating means.

For example, the present invention can be used when the pressure generating means is an electrostatic actuator comprising a diaphragm that is displaced by electrostatic force as taught in Japan Unexamined Patent Publication (kokai) 7-81088 (1995-81088). As described in said Publication, a residual charge accumulates in the diaphragm when a pressure generating means of this type is driven for a prescribed time, and the relative displacement of the diaphragm tends to decrease. By applying a second electric pulse of polarity different from that of the first electric pulse, however, an increase in viscosity near the nozzle can be prevented, and the residual charge can be simultaneously removed.

An ink jet printer having a plurality of nozzles for ejecting ink drops, pressure generating means disposed corresponding to said nozzles for pressurizing ink in said nozzles, and a means for transporting said nozzles relative to a printing medium for printing, comprises according to a further embodiment of the present invention a common terminal connected in common to each of said pressure generating means, a plurality of segment terminals connected individually to said pressure generating means, a first drive means for applying a first electric pulse to the common terminal, and a second drive means for applying a second electric pulse of an amplitude different from the amplitude of the first electric pulse to a segment terminal. The difference between the first electric pulse applied to the common electrode, and the second electric pulse applied to the segment electrode, is thus applied to a pressure generating element. Each electric pulse is applied separately by the respective drive means to a pressure generating element. As result, electric pulses of two different amplitudes can be selectively applied to a pressure generating element without complicated control.

DESCRIPTION OF PREFERRED EMBODIMENTS

The preferred embodiment of an ink jet printer according to the present invention is described below with reference to the accompanying figures.

Figure 1:
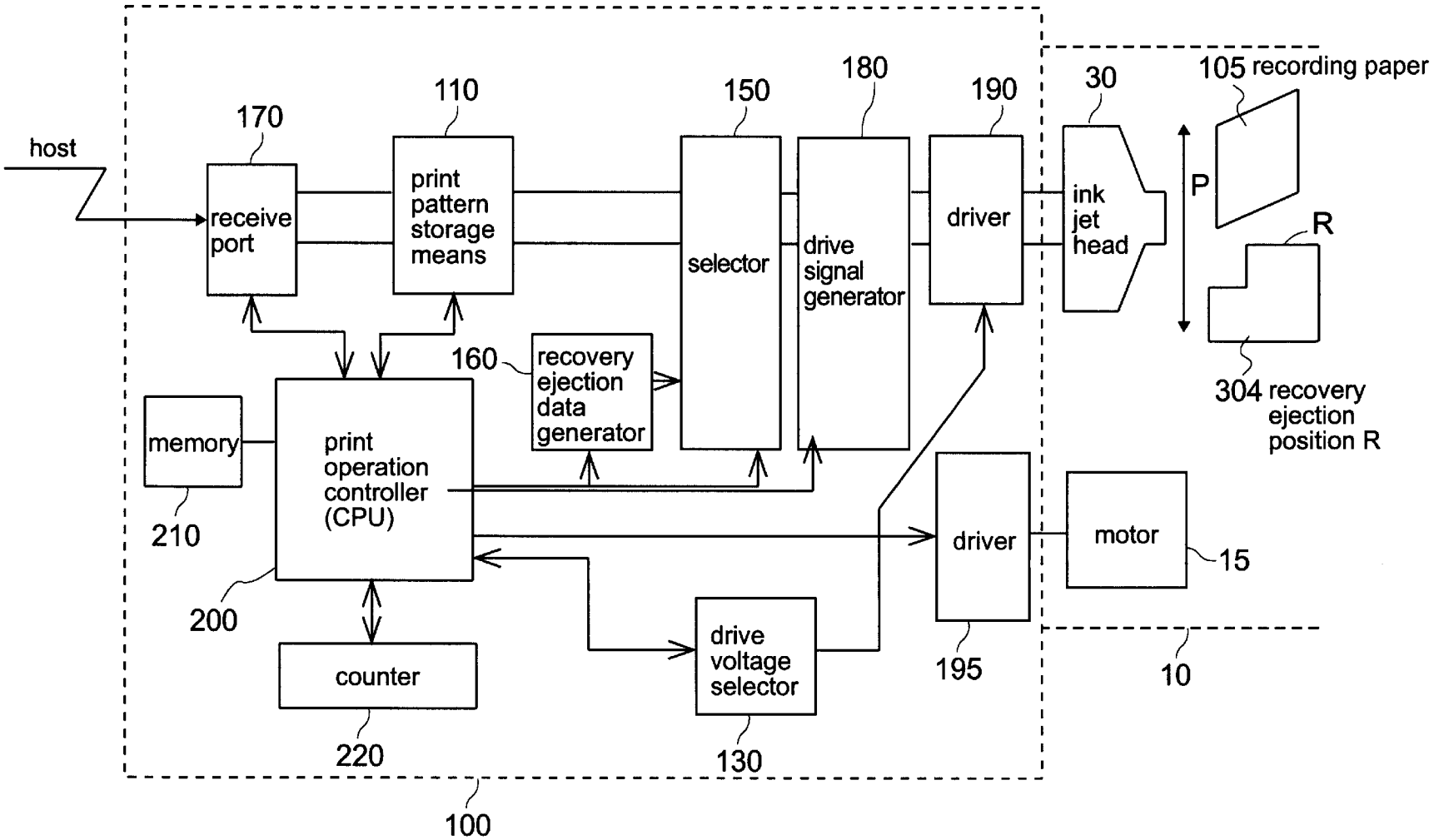
FIG. 1 is a block diagram of an ink jet printer according to a preferred embodiment of the present invention.
Figure 2:
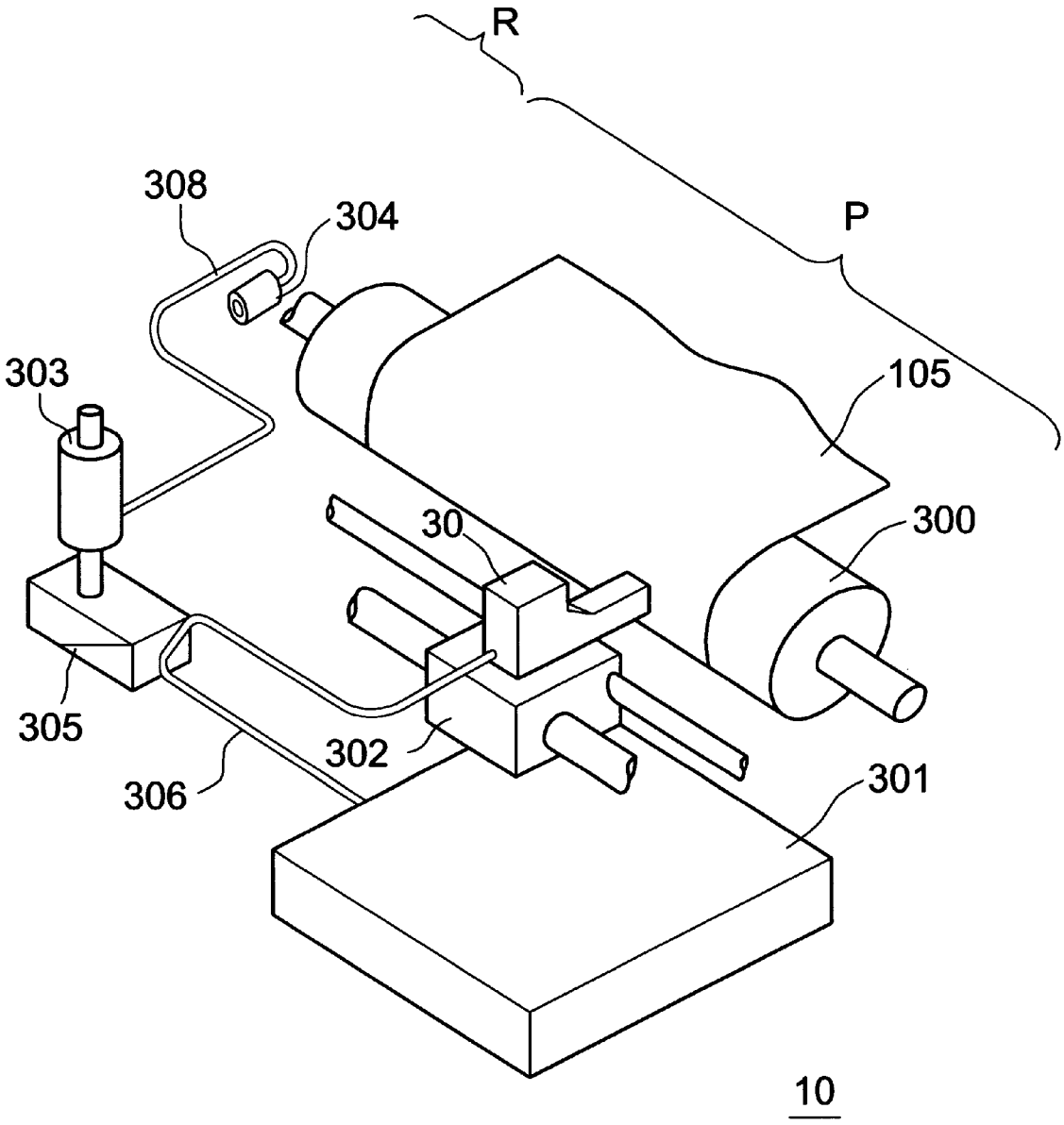
FIG. 2 is a perspective view of an exemplary printing unit 90 shown in FIG. 1.

FIG. 1 is a block diagram of an ink jet printer according to a preferred embodiment of the present invention, and FIG. 2 is a perspective view of an exemplary printing unit 90 shown in FIG. 1.

As shown in FIG. 1, an ink jet printer according to the present invention comprises a printing unit 90 and a control unit 100 for controlling the printing unit 90 based on an image signal transmitted from a host.

The printing unit 90 is comprised as shown in FIG. 2 and described below. The recording paper 105 is transported by a platen 300, and ink is supplied to the ink jet head 30 through an ink supply tube 306 from an ink tank 301 in which ink is stored.

The ink jet head 30 comprises a pressure generating means such as a piezoelectric element, heating element, or electrostatic actuator, and is transported on a carriage 302. The carriage 302 is driven by a motor 80 (FIG. 1), and moves in a direction perpendicular to the transportation direction of the recording paper 105. A pump 303 has an ink recovery process whereby ink from inside the ink jet head 30 is recovered to a waste ink tank 305 by pumping the ink through a cap 304 located at the recovery ejection position R and waste ink recovery tube 308. It should be noted that this ink recovery process of the pump 303 is used on ink jet heads which can no longer be refreshed by a recovery ejection process. This can occur when, for example, the ink jet printer has not printed for an extended period of time, or when air becomes trapped in a nozzle.

The ink jet head 30 mounted on carriage 302 travels between printing area P, which is approximately the same width as platen 300, and the front of cap 304 (recovery ejection position R). The ink jet head 30 ejects ink for recording when travelling through printing area P; the recovery ejection operation for preventing nozzle clogging is performed at recovery ejection position R.

The cap 304 can advance towards ink jet head 30 and retract from ink jet head 30. When ink is recovered from ink jet head 30, the cap 304 advances to cover the nozzles of the ink jet head 30, and ink is ejected from all nozzles of the ink jet head 30 into the cap 304. Recovery ejecting can be accomplished without covering the nozzles with cap 304 when printing is in progress, and can be accomplished with the nozzles capped when the ink jet printer is in a standby state.

The recovery ejection position R is also normally used as the home position of carriage 302. When the ink jet printer is powered on, the nozzles are covered by cap 304, and the ink jet head 30 waits at the recovery ejection position R until a print command is received.

A receive port 170 shown in FIG. 1 is a serial or parallel communications port for receiving an image signal from a host device. Image data contained in the image signal received through the receive port 170 is stored to a print pattern storage means 110 such a random access memory (RAM). When the print pattern storage means 110 is RAM, data stored to a memory address specified by a print operation controller (CPU) 200 using signals such as an address signal and read/write signal is sequentially read and output.

A recovery ejection data generator 160 generates data for recovery ejecting, i.e., generates the data used to drive and eject ink drops from all nozzles, and outputs the data to a selector 150. The selector 150 selects either the output of print pattern storage means 110 or recovery ejection data generator 160, and passes the selected data to the drive signal generator 180.

A drive signal generator 180 generates a drive data signal D1 to Dn for each nozzle N1 to Nn based on the selected data output from the selector 150. Drive data signal D1 to Dn defines the width and timing of the drive pulse applied to the pressure generating means of each nozzle, and is output synchronized to a timing pulse output from the print operation controller (CPU) 200.

Memory 210 is RAM for storing print commands and other data containing in the image signal, and a read only memory (ROM for storing the program controlling other components. As a result, a print operation controller (CPU) 200 accesses the program stored in memory 210 to appropriately control the various components.

A counter 220 is a timer or similar device for counting the amount of time following recovery ejecting. When a prescribed period has passed, the counter 220 outputs a time-up signal instructing output of the recovery ejecting signal, or sets a flag to indicate that a prescribed period has elapsed.

An ink jet head driver 190 boosts the drive signal output from the drive signal generator 180 to drive the ink jet head 30. An other driver 195 drives the motor 80. Operation of the motor 80 is controlled by a control signal from the CPU 200.

The drive voltage selector 130 selects the drive pulse applied to the pressure generating means of the ink jet head 30. The drive pulse is either a high amplitude drive pulse causing ink drop ejecting, or a low amplitude drive pulse for mobilizing ink inside the nozzles without ejecting ink drops. The drive voltage selector 130 controls the ink jet head driver 190 to apply a high amplitude drive pulse to any nozzle operated to eject ink for recording according to the drive signal output by the drive signal generator 180, and to apply a low amplitude drive pulse to all other nozzles.

EMBODIMENT OF AN INK JET HEAD USED BY THE PRESENT INVENTION

Figure 3:
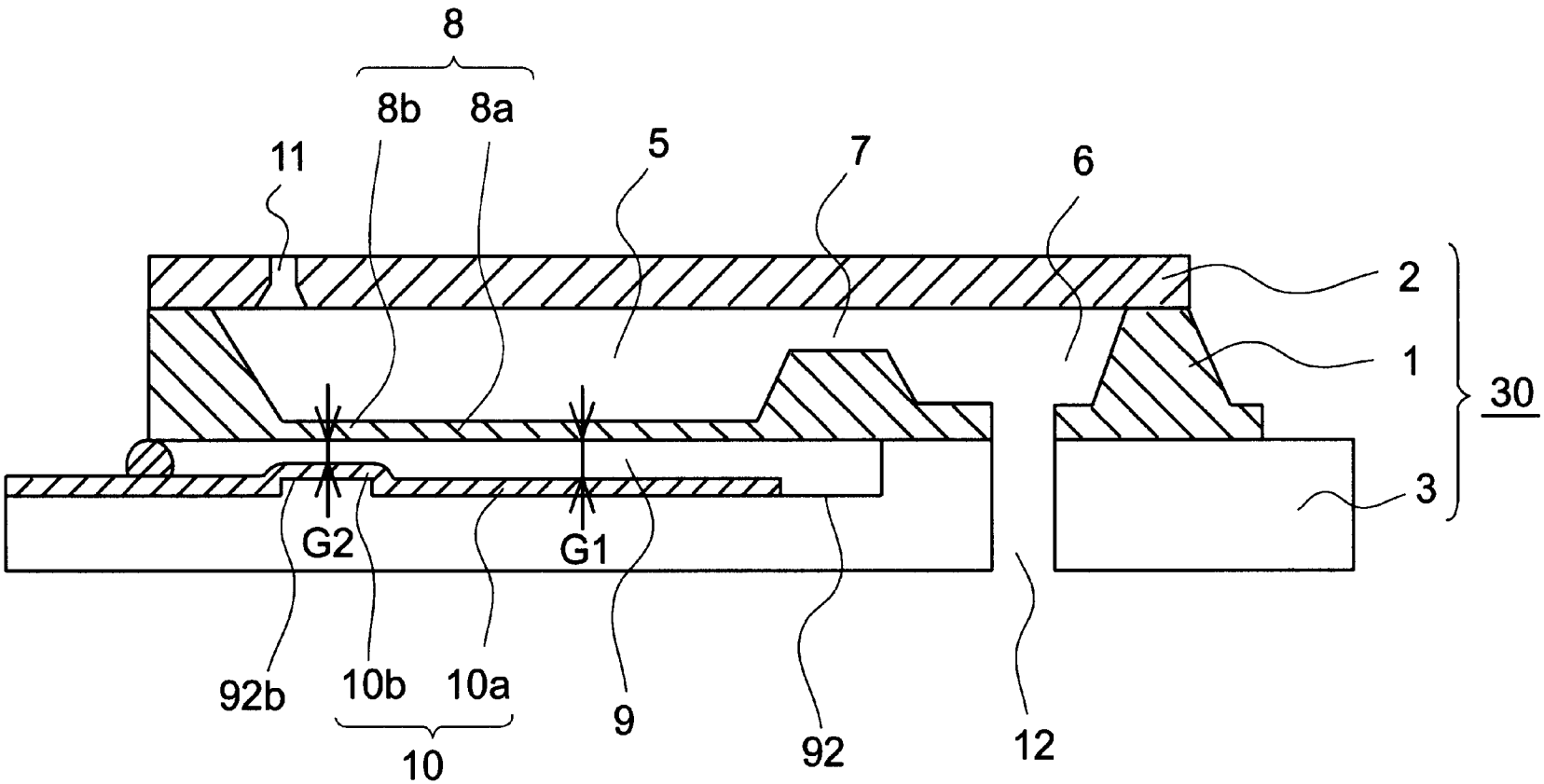
FIG. 3 is a cross-sectional view of an exemplary ink jet head 30 shown in FIG. 1.
Figure 4:
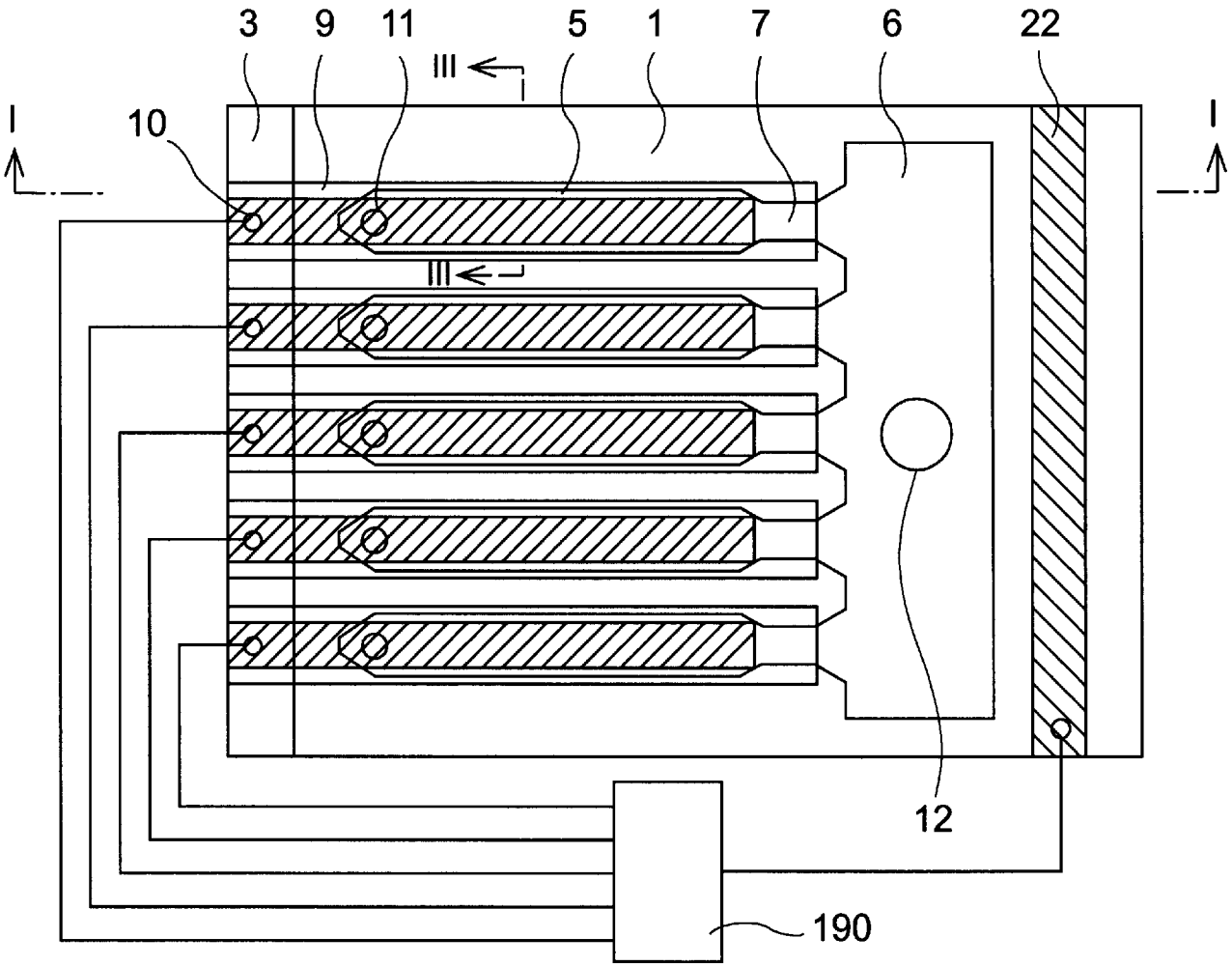
FIG. 4 are plan views of the ink jet head 30 shown in FIG. 3.
Figure 5A:
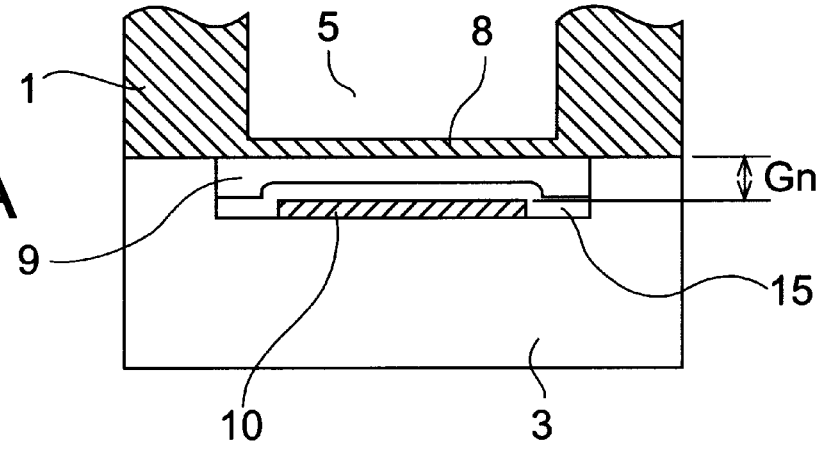
FIG. 5 is a partial cross-sectional view used to describe the operation of the ink jet head 30 shown in FIG. 3, FIG. 5A showing the standby state, FIG. 5B the ink intake state, and FIG. 5C the ink compression state.
Figure 5B:
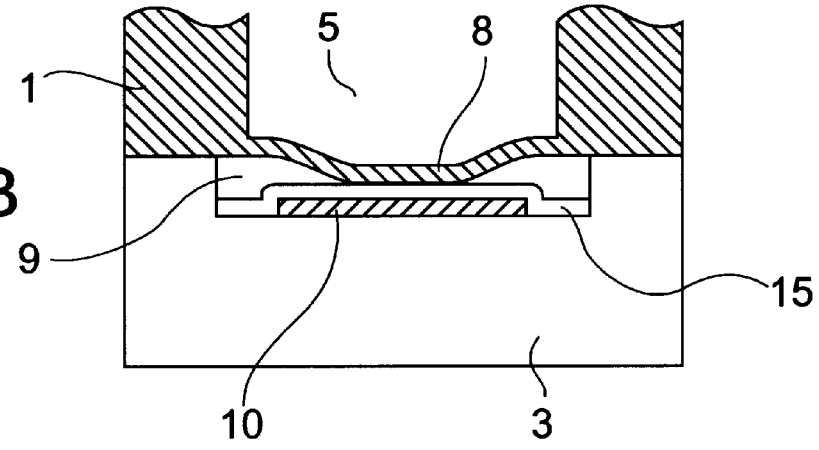
Figure 5C:
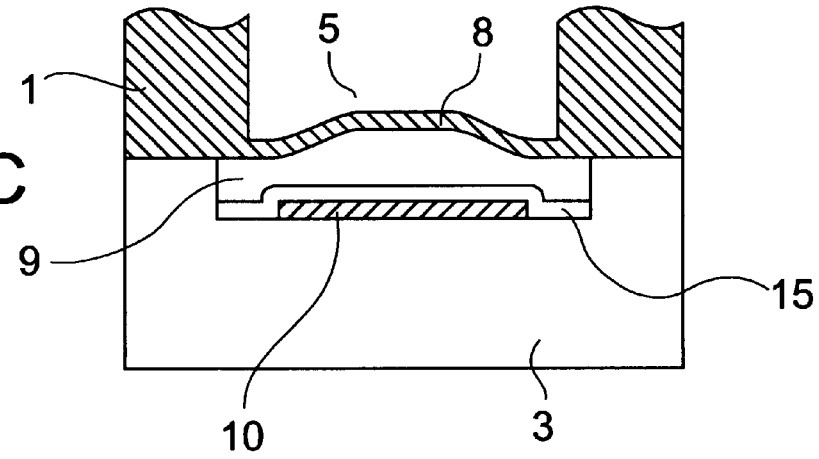

FIG. 3 is a cross-sectional view of an ink jet head appropriate to the present invention, FIG. 4 is a plan view of said ink jet head, and FIGS. 5A–5C partial cross sectional view thereof.

As will be known from the figures, this ink jet head 30 is a three layer structure comprising a silicon nozzle plate 2 disposed on top of a silicon substrate 1, and a borosilicate glass plate 3 having a thermal expansion coefficient substantially equal to that of silicon disposed below the silicon substrate 1 as shown in FIG. 3. Etched into the surface (top surface as seen in FIG. 3) of the middle silicon substrate 1 are recesses that function as a plurality of independent ink chambers 5 and a common ink chamber 6 interconnected to each of the independent ink chambers 5 by means of corresponding ink supply paths 7. It should be noted that the formation of ink chambers 5, common ink chamber 6, and ink supply paths 7 is completed by covering the recesses, i.e., the surface of silicon substrate 1, with the nozzle plate 2.

A plurality of nozzles 11 is formed in the nozzle plate 2 at a position corresponding to an end part of each ink chamber 5. Each nozzle 11 is open to the corresponding ink chamber 5. An ink supply opening 12 open to common ink chamber 6 is also formed in nozzle plate 2. Ink is supplied from ink tank 301 (FIG. 2) through ink supply tube 306 (FIG. 2) to charge the common ink chamber 6 through ink supply opening 12. The ink charge in common ink chamber 6 is then supplied through ink supply paths 7 to the corresponding independent ink chambers 5.

The bottom wall 8 of ink chamber 5 is thin, and functions as a diaphragm that can be flexibly displaced up and down as shown in FIG. 3. This bottom wall 8 part of ink chamber 5 is therefore alternatively referred to in the following description as diaphragm 8.

The surface of borosilicate glass plate 3 bonded in contact with the bottom of silicon substrate 1 is also etched to form a plurality of shallow recesses 9 at positions corresponding to the ink chambers 5 in silicon substrate 1. The bottom wall 8 of each ink chamber 5 therefore opposes the surface 92 of corresponding recess 9 with an extremely narrow gap therebetween. A surface projection 92*b* projecting from surface 92 toward bottom wall 8 is provided on the surface of recess 9 in the area of nozzle 11. As a result, the gap between surface projection 92*b* and bottom wall 8*b* is less than the gap at other areas between surface 92 and bottom wall 8*a*.

The bottom wall 8 of each ink chamber 5 functions as an electrode for storing a charge. A segment electrode 10 is formed on recess surface 92 of glass plate 3 in a position opposite bottom wall 8 of each ink chamber 5. The surface of each segment electrode 10 is covered by an inorganic glass insulation layer 15 of thickness G0 (see FIG. 5). As a result, each segment electrode 10 and the corresponding ink chamber bottom wall 8 form opposing electrodes having an insulation layer 15 disposed therebetween and an electrode gap that varies according to the location. More specifically, the electrode gap between these opposing electrodes is a distance G2 near the nozzle, and a distance G1 in other areas.

As shown in FIG. 4, ink jet head driver 190 charges and discharges the opposing electrodes according to the control signal output from the CPU 200 and the drive signal output from drive signal generator 180. The driver 190 outputs directly to each segment electrode 10, and directly to a common electrode terminal 22 formed on silicon substrate 1. Impurities injected to silicon substrate 1 are conductive, enabling common electrode terminal 22 to supply a charge to bottom wall 8. When it is necessary to supply a voltage to the common electrode with lower resistance, a metallic thin-film or other conductive material can be formed on one surface of the silicon substrate 1 by such methods as vapor deposition or sputtering. The silicon substrate 1 and borosilicate glass plate 3 are bonded in the present exemplary embodiment by anodic bonding, and a conductive film is therefore formed on the same surface of the silicon substrate 1 as the ink path is formed.

A cross sectional view of the ink jet head through line III—III of FIG. 4 is shown in FIG. 5. When a drive voltage is applied from driver 190 to opposing electrodes, Coulomb force is produced in the opposing electrode gap, thus displacing the bottom wall (diaphragm) 8 toward segment electrode 10 and increasing the capacity of the ink chamber 5 (see FIG. 5B). When the driver 190 then causes the charge stored in the opposing electrodes to rapidly discharge, the elastic restoring force of the bottom wall 8 causes the bottom wall 8 to return to the original static position, thereby rapidly compressing the capacity of the ink chamber 5 (FIG. 5C). The pressure thus generated inside the ink chamber causes part of the ink charge in ink chamber 5 to be ejected as an ink drop from the nozzle 11 corresponding to that ink chamber.

As described above, however, the opposing electrode gap is formed with both a small gap G2 and a large gap G1. It is therefore possible to displace bottom wall 8*b*of diaphragm 8 located at small gap G2 to the opposing wall of surface projection 92*b* by applying a smaller drive voltage than is needed to displace bottom wall 8*a* at the large gap G1.

Two vibration modes can therefore be achieved by appropriately applying a high drive voltage causing displacement of the entire diaphragm toward opposing wall surface 92, and a low drive voltage causing displacement of only diaphragm bottom wall 8*b* at small gap G2. The vibration mode achieved by applying a high drive voltage causes diaphragm 8 to vibrate sufficiently to eject an ink drop, and the vibration mode achieved by applying a low drive voltage produces diaphragm vibrations mobilizing ink around the nozzle.

DRIVE CIRCUIT

Figure 6:
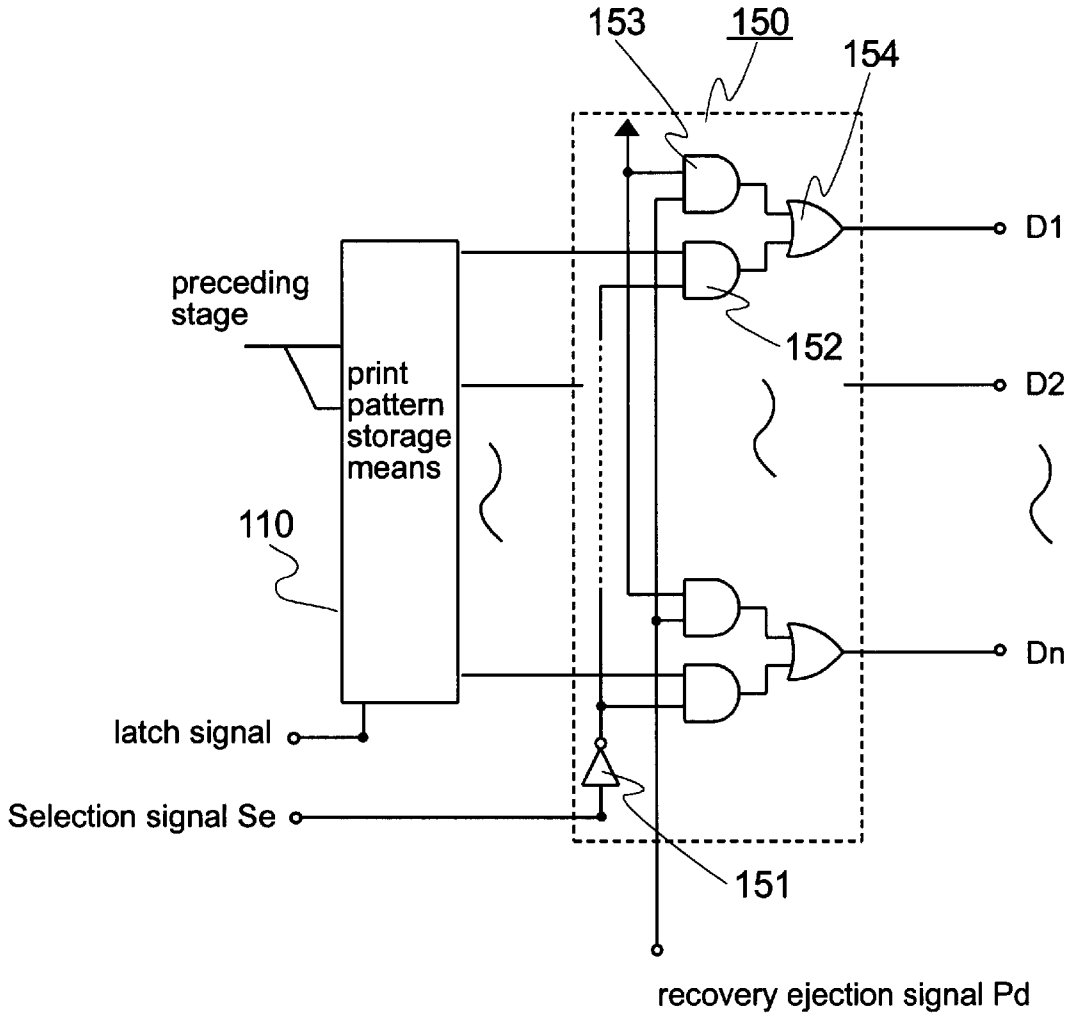
FIG. 6 is a circuit diagram of one example of the selection means 150 shown in FIG. 1.
Figure 7:
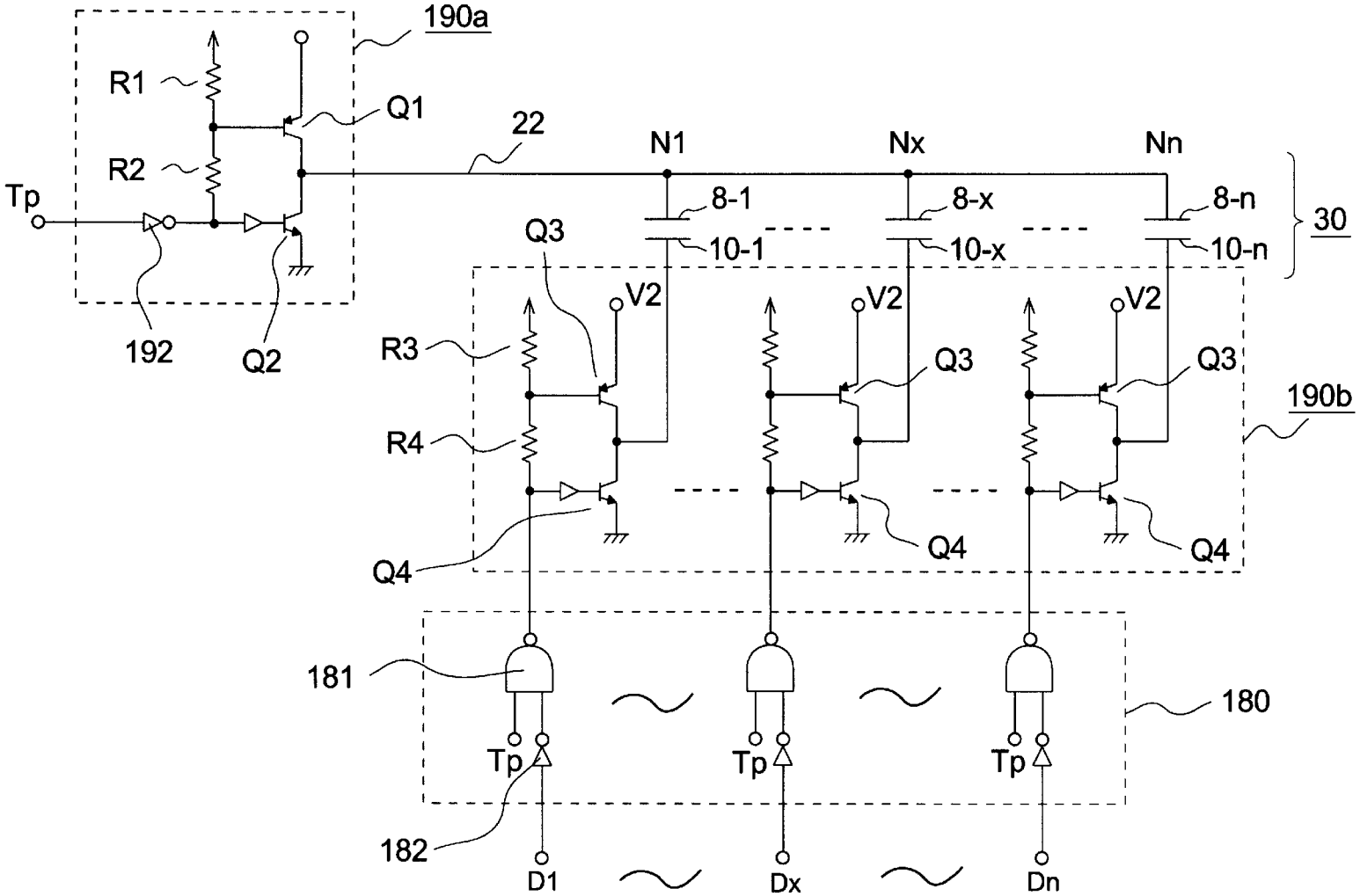
FIG. 7 is a circuit diagram of one example of the driver 190 shown in FIG. 1.

An exemplary embodiment of a drive circuit according to the present invention is described next below with reference to FIGS. 6 to 8. FIG. 6 is a circuit diagram of a preferred embodiment of a selector 150 shown in FIG. 1, and FIG. 7 is a circuit diagram showing the major components of a driver 190 comprising a drive voltage selection means.

Referring to FIG. 6, a receive buffer 110 functions as the print pattern storage means shown in FIG. 1. Based on drive data signal D1 to Dn output from the selector 150, a drive pulse signal generator 180 applies a drive signal to each nozzle N1 to Nn. It should be noted that receive buffer (print pattern storage means) 110, selector 150, and drive pulse signal generator 180 can be integrated into a single gate array.

Receive buffer 110 stores one column of print data, outputs the data at a latch signal from the print operation controller (CPU) 200, and then obtains the next data set from the preceding stage.

As shown in FIG. 6, selector 150 comprises two AND elements 152 and 153 and one OR element 154 per nozzle. Based on a selection signal Se 161 output from the CPU 200, the selector 150 selects either print data output from the receive buffer 110, or recovery ejection data produced by recovery ejection data generator 160, and outputs to drive pulse signal generator 180.

the selection signal Se is low, NOT element 151 outputs high, resulting in a high input to AND element 152. As a result, the print data supplied from the receive buffer 110 to the other input of AND element 152 is sent to the drive pulse signal generator 180. When the selection signal Se 161 is high, the data from the receive buffer 110 is not output to the drive pulse signal generator 180, and the recovery ejection data is sent to the drive pulse signal generator 180. As a result, the data sent to the drive pulse signal generator 180 results in periodic ink drop ejecting from all nozzles.

A timing pulse Tp of a prescribed pulse width is applied to one input of each NAND element 181 of drive pulse signal generator 180. Data signal D1 to Dn output from selector 150 is inverted by NOT element 182, and the inverted data signal is applied to the other input of each NAND element 181.

The ink jet head driver 190 comprises a driver 190*a* for driving the common electrode terminal 22 (diaphragm 8) side of the ink jet head, and a driver 190*b* for driving each segment electrode 10 based on the drive data signal D1 to Dn. Driver 190*a* switches the voltage applied to the common electrode terminal 22 between a voltage V1 and the ground (0 V); driver 190*b* switches the voltage applied to the segment electrode 10 between a second voltage V2 and the ground (0 V). Note that V1 is greater than V2, and two different voltages, V1 and V1–V2, (or three voltages if 0 V is included) can be applied to the opposing electrode gap (between the diaphragm 8 and segment electrode 10).

Driver 190*a* comprises primarily transistors Q1 and Q2, and resistances R1 and R2. The timing pulse Tp is applied to the input terminal of the driver 190*a*. When the timing pulse Tp switches to the on state (high), transistor Q1 is on, and voltage V1 is applied to common electrode terminal 22. When the timing pulse Tp is off (low), transistor Q1 is off, transistor Q2 is on, and the common electrode terminal 22 is connected to the ground (0 V).

The other driver 190*b* comprises a plurality of circuits comprising primarily transistors Q3 and Q4 and resistances R3 and R4. Note that the number of these circuits matches the number n of segment electrodes 10. Each input terminal of driver 190*b* is connected to an output terminal of drive pulse signal generator 180. When data Dx for an X-th nozzle 11*x* goes high, i.e., when an ink drop is to be ejected from nozzle 11*x*, and timing pulse Tp goes on (high), transistor Q4 goes on and the corresponding segment electrode 10*x* is connected to the ground (0 V).

When data Dx for nozzle 11*x* goes low, i.e., when an ink drop is not to be ejected from nozzle 11*x*, and timing pulse Tp goes on (high), transistor Q3 goes on and voltage V2 is applied to the corresponding segment electrode 10*x*.

Figure 8:
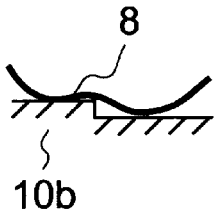
FIG. 8 is a logic table showing the relationship between input signals and output signals of the driver 190 shown in FIG. 7.
Figure 8:
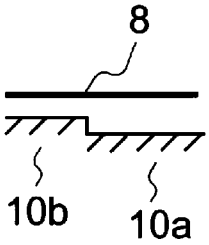
Figure 8:
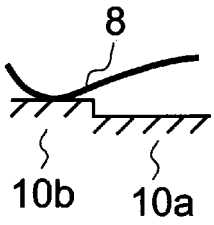

A logic table showing the relationship between the timing pulse Tp, data signal Dx, and the potential of the opposing electrodes is shown in FIG. 8. As will be known from this table, when timing pulse Tp and data signal Dx are both high, the potential difference between the opposing electrodes is V1. Charging thus causes the entire diaphragm 8 to be displaced toward the segment electrode as shown by state (1) in FIG. 8. When the timing pulse Tp goes low from this state, the opposing electrodes become equipotential, the stored charge is discharged, and the diaphragm 8 returns to the original non-displaced position. This produces pressure inside ink chamber 5, which causes an ink drop to be ejected from nozzle 11 (state 2).

When the timing pulse Tp is high and data signal Dx is low, the potential difference of the opposing electrode gap is V1–V2, and the diaphragm 8 is displaced only in the area of the segment electrode area 10*b* (state 3). When the timing pulse Tp then goes low from this state, the opposing electrode gap again becomes equipotential, the stored charge is discharged, and the diaphragm 8 returns to the original non-displaced position. In this case, however, the amplitude of diaphragm 8 vibration is smaller than when the diaphragm 8 returns from the state (1) position to the state (2) position. The pressure inside the ink chamber 5 therefore does not rise sufficiently to eject an ink drop from the nozzle 11, and vibration of diaphragm 8 results only in mobilizing ink around the nozzle 11.

The operation of the circuits comprised as above is described next below with reference to the timing chart shown in FIG. 9.

For printing, the selection signal Se output from the CPU 200 is low. A latch signal 120 from the CPU 200 sets the column print data read into receive buffer 110 to the drive pulse signal generator 180. The selection signal Se from the CPU 200 remains low while printing continues, thereby steadily supplying the column print data to the drive signal generator 180 and therefrom to the driver 190.

Figure 9:
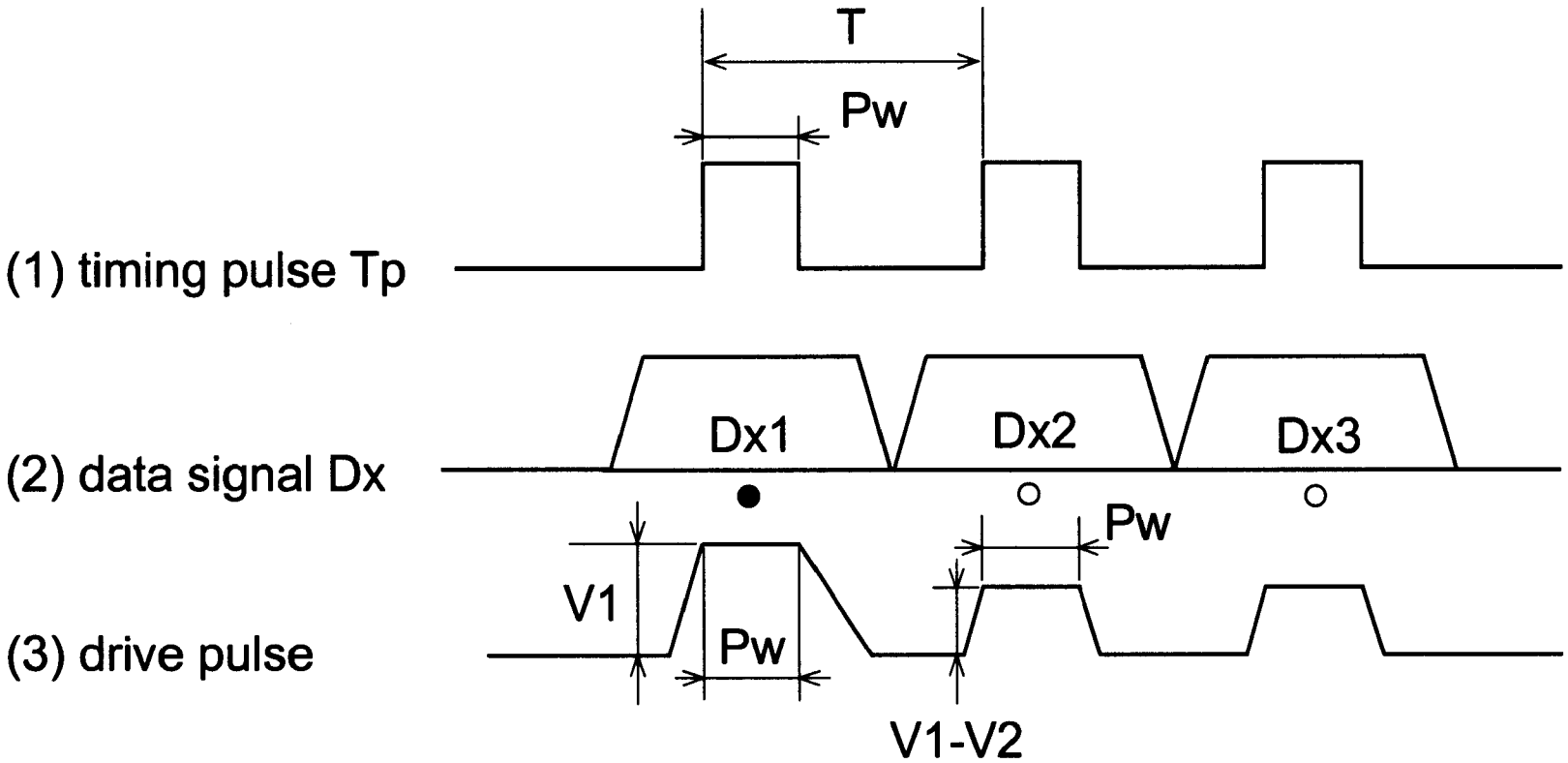
FIG. 9 is a timing chart of ink jet head operation during printing, and is used to describe an ink jet printer drive method according to a preferred embodiment of the present invention.

The timing pulse Tp input to drivers 190*a* and 190*b* is a periodic pulse of period T and pulse width Pw as shown in FIG. 9. The time from the start of opposing electrode gap charging to the start of discharging is determined by pulse width Pw.

The motor 80 for transporting carriage 302 is driven synchronized to timing pulse Tp, and the input of latch signal to the receive port is synchronized to timing pulse Tp.

Based on the print data, the data signal Dx input to the drive pulse signal generator 180 is output high synchronized to the timing pulse Tp when an ink drop is to be ejected. The data signal Dx is therefore sequentially output high-low-low when dot 1 is printed and dots 2 and 3 are not printed as shown in FIG. 9. This results in drive pulses of pulse width Pw and amplitude V, V1–V2, and V1–V2 being sequentially applied to the opposing electrode gap. This sequence of drive pulses causes ink drop ejecting at dot 1, and ink mobilization around the nozzle without ink drop ejecting at dots 2 and 3.

The simple circuit configuration of the present invention can thus apply a low amplitude drive pulse to non-ejecting nozzles only to mobilize ink around the nozzle and prevent a rise in the viscosity of ink around the nozzle while printing is in progress, and can accomplish this without complicated control. It is therefore possible to suppress a rise in the viscosity of ink in infrequently used nozzles. This means that differences in viscosity at the nozzle tip resulting from differences in the frequency of nozzle use can be reduced, the interval between nozzle recovery operations can be increased, and wasteful consumption of ink during nozzle recovery can be reduced. The method of the present invention is particularly effective in the case of a color ink jet printer having a plurality of nozzles grouped by color because a noticeable difference in the frequency of nozzle use occurs easily with such printers.

Latch signal output from the CPU 200 stops and the printing process is interrupted during the nozzle recovery process. The ink jet head 30 is then moved to the recovery ejection position R, selection signal Se is set high, recovery ejection data causing all nozzles to eject periodically is set to the drive pulse signal generator 180, and all nozzles are thus operated to eject plural times.

If all data signals are held low and timing pulse Tp is applied while ink jet head 30 is moved to the recovery ejection position R, a rise in the viscosity of ink around the nozzle can be suppressed by applying a low amplitude drive pulse causing mobilization of ink near the nozzle.

It should be noted that an exemplary drive circuit according to the preceding embodiment of the present invention has been described driving an ink jet head comprising an electrostatic actuator as a pressure generating means. The invention shall not be so limited, however, and the same effect can be achieved in ink jet heads in which a piezoelectric element, heating element, or other type of pressure generating means is used. More specifically, the present invention can apply two drive pulses of different amplitudes to such other types of ink jet heads. Displacement varies according to the voltage of the applied drive pulse when a piezoelectric element is used, and ink around the nozzle can therefore be mobilized without ink ejecting. The amount of heat generated likewise varies with a heating element, and a low amplitude drive pulse can therefore again be used to mobilize ink around the nozzle without ink ejecting.

PREFERRED EMBODIMENT OF A CONTROL METHOD

Figure 10A:
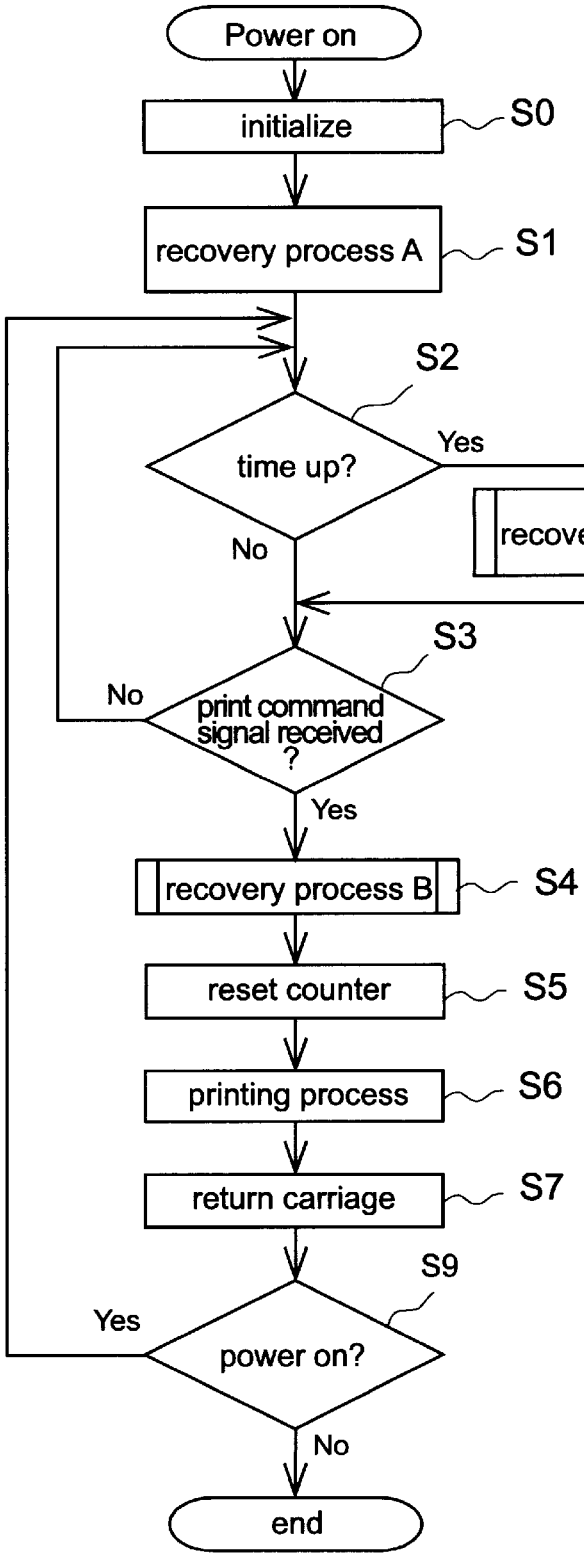
FIGS. 10A and 10B are flow charts used to describe an alternative embodiment of an ink jet printer drive method according to the present invention.
Figure 10B:
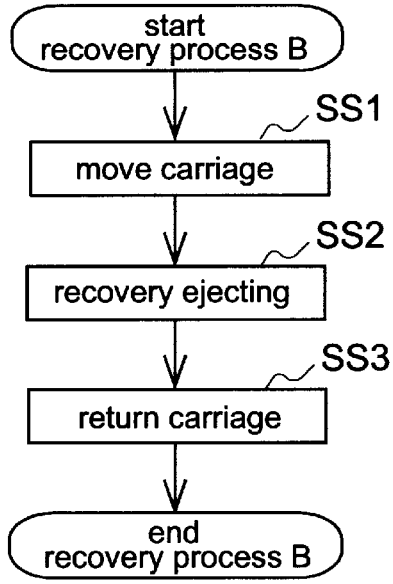

A preferred embodiment of an ink jet printer control method according to the present invention is described next below with reference to the flow charts in FIG. 10. Note that the main routine is shown in FIG. 10A, and a subroutine is shown in FIG. 10B.

When the printer power is turned on, the control unit 100 and printing unit 90 are initialized (step SO). Recovery process A is then accomplished (step S1) to expel any ink that had become more viscous during the period of printer non-use. Recovery process A applies suction to the capped nozzles using pump 303, and by this action removes ink that had become too viscous to eject from the nozzles.

It should be noted here that recovery process B described below differs from recovery process A in that it applies a drive pulse to the pressure generating means to expel by forcing out from the nozzle ink that had increased in viscosity near the nozzle.

After recovery process A is completed, counter 220 is reset and begins counting a prescribed period. This counting operation is used to determine the passage of a required minimum period, and to count the time elapsed from that minimum period. Output of a time-up signal is then detected (step S2) to determine whether the counter 220 has counted the prescribed time, that is, whether the prescribed period has elapsed. If the time-up signal is detected, recovery process B is performed (step S8).

Recovery process B is shown as subroutine (b) comprising steps SS1 to SS3 in FIG. 10. This subroutine starts by moving carriage 302 carrying ink jet head 30 to the home position, which is recovery ejection position R (step SS1). Recovery ejecting (step SS2) then expels increased viscosity ink from all nozzles into the cap. Ink is generally ejected anywhere from several to several hundred times per nozzle to expel any defective, increased-viscosity ink from the nozzles. After ejecting, the carriage is returned to the position from which it was moved to the recovery ejection position R (step SS3) to complete recovery process B.

It should be noted that if the carriage is already positioned at the recovery ejection position R when the time-up signal is output, it is obviously not necessary to move the carriage (step SS1 can be skipped) before recovery ejecting in step SS2, and it is not necessary to move the carriage when recovery ejecting is completed (step SS3 can be skipped). Thus, it is sufficient to simply eject ink from the nozzles while the nozzles remain capped.

It should be further noted that the number of ink expulsions accomplished in recovery process B is determined in this embodiment by a prescribed time counted by counter 220.

If in step S2 the time-up signal is not detected, it is determined (step S3) whether printing is to be accomplished. If printing is not requested, step S3 loops back to step S2.

If a print command signal has been received from a host device and printing is requested, recovery process B is performed (step S4), and the counter 220 is then reset (step S5). After the printing process is then accomplished (step S6), the carriage is returned to the home position (step S7), and the nozzles are capped. If the power is still on (step S9), the procedure then loops back to step S2. If the power is off (step S9), the procedure terminates.

As thus described, a recovery process A using a pump to purge the nozzles is first accomplished when the power is turned on. Thereafter, a recovery process B to recover the nozzles by ejecting is performed immediately before printing commences and at a prescribed regular interval when printing is not performed.

It should be further noted that after recovery process A, the control method of the present invention applies a low amplitude drive pulse to all nozzles when not printing, and to the non-ejecting nozzles when printing, to constantly mobilize ink near the nozzles. As a result, the frequency of recovery process B can be reduced, and ink waste can be prevented, when compared with methods which do not apply this type of drive pulse.

Figure 11:
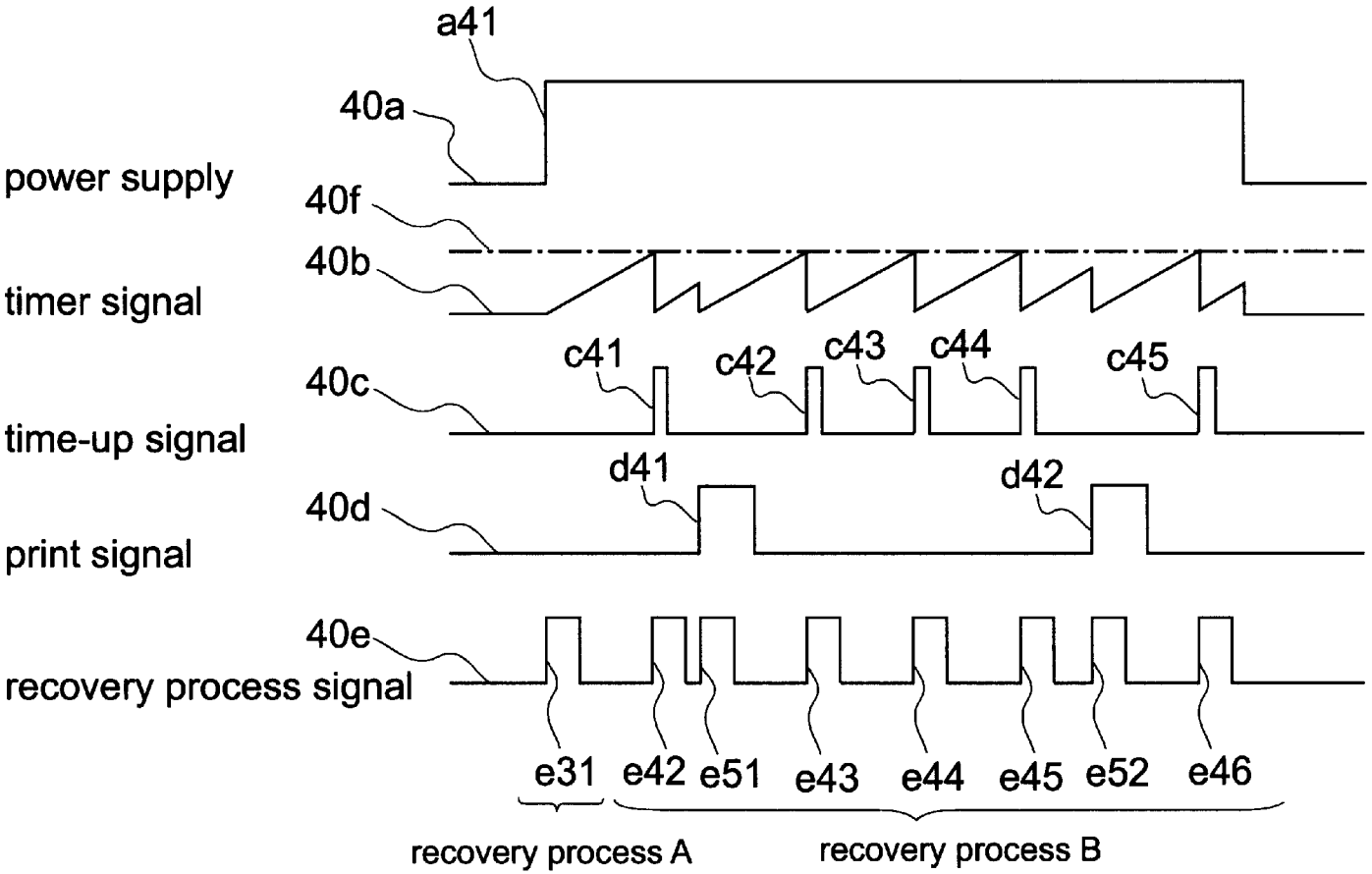
FIG. 11 is a timing chart showing various signals used in the ink jet printer drive method shown in FIG. 10.

FIG. 11 is a timing chart of various signals used to achieve the embodiment of the invention described with reference to FIG. 10.

Signal 40*a* indicates the power supply state; 40*b* indicates the count of the counter 220, that is, the timer signal. The dot-dash line 40*f* indicates the time-up time counted by the timer signal 40*b*. The timer signal 40*b* is indicative of a particular value such as time or a clock count. The time-up signal 40*c* is output by the counter 220 when the prescribed time is up. The print signal 40*d* is received through receive port 170. The recovery process signal 40*e* is output appropriately by the CPU.

When the CPU receives time-up signal 40*c* and print signal 40*d*, it instructs the various means shown in FIG. 1 to perform the recovery process according to the procedure of the flow chart shown in FIG. 10.

When the power supply is turned on a41, recovery process A is performed (e31). If the print signal 40*d* is not received and the printer therefore does not print within a prescribed time, the time-up signal 40*c* is set high to a time-up state c41. This causes recovery process B (e42) to be performed. Soon thereafter when printing occurs d41, the print signal 40*d* causes the counter 220 to be reset and the recovery process B (e51) to be performed. If the print signal 40*d* is thereafter not detected for a sufficiently long period, the recovery process B is repeated (e43, e44, e45) each time the time-up signal 40*c* indicates the prescribed time has elapsed (c42, c43, c44).

It should be noted that if the time-up time 40*f* is short, the nozzle recovery process will be performed frequently, ink consumption will therefore increase, and the amount of ink available for printing will thus decrease. As a result, the print capacity (number of printable characters) per head or cartridge decreases. Conversely, if the time-up time 40*f* is too long, the amount of unusable ink in the nozzles increases, and the amount of ink that must be ejected in recovery process B immediately before printing increases.

As described above, however, the control method of the present invention causes a low amplitude drive pulse to be applied to all nozzles during non-printing times to mobilize ink around the nozzles. When compared with methods in which such a drive pulse is not applied, the method of the present invention can therefore set the time-up time 40*f* to a longer time without increasing the ink volume ejected during recovery process B. More specifically, the control method of the present invention can decrease the frequency of the nozzle recovery process and thereby prevent ink waste.

As also described above, the method of the present invention uses a time-up signal 40*c* output by a counter 220, and a print signal 40*d* received from a host device, as triggers for initiating the recovery process B. It will be obvious, however, that it is also possible to use only one of these signals as the trigger for recovery process B. For example, the time-up signal could be used as a trigger for recovery process A, and only the print signal could be used as a trigger for recovery process B. In this case, recovery process B could be performed to eject ink several ten times preceding a printing process when a print signal is received from a host, recovery process B could be performed to eject several times after printing a prescribed number of lines, and recovery process A could be triggered by the time-up signal.

PREFERRED EMBODIMENT OF A DRIVE PULSE FOR A NOZZLE RECOVERY PROCESS

Figure 12:
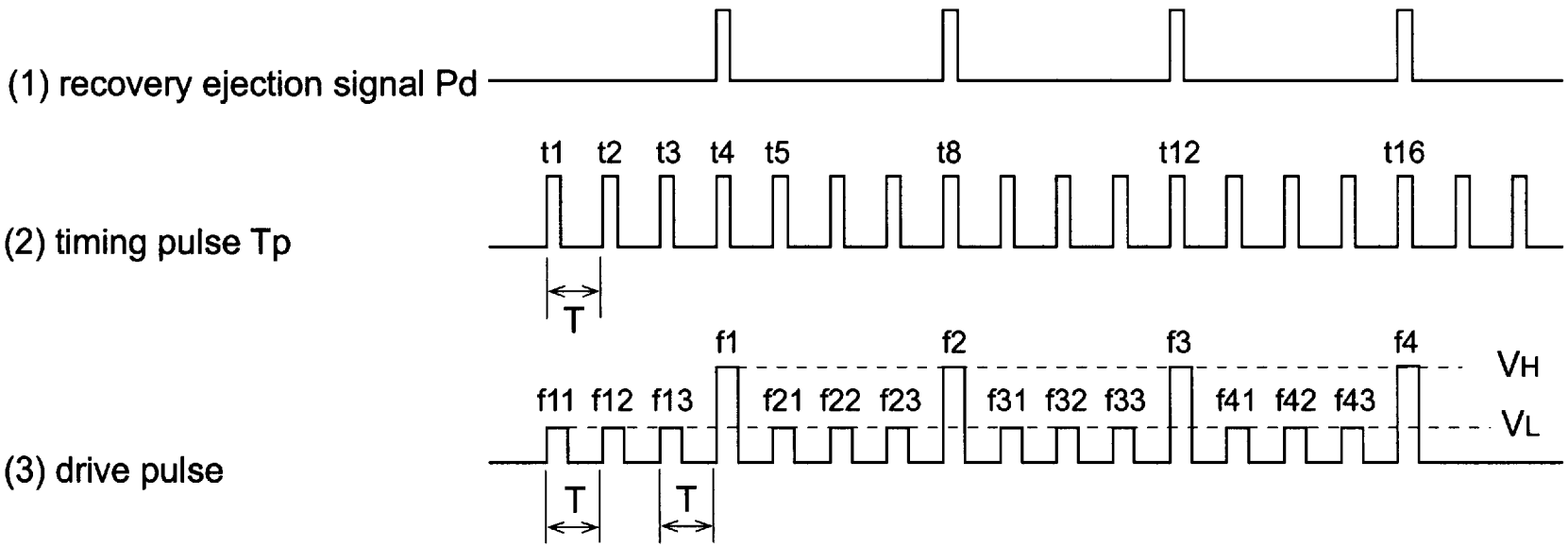
FIG. 12 is a timing chart of ink jet head operation during a nozzle recovery process according to an alternative embodiment of an ink jet printer drive method according to the present invention.

FIG. 12 is a timing chart of an exemplary drive pulse used for a nozzle recovery process according to the present invention.

Note that the circuit diagrams shown in FIG. 6 and FIG. 7 are appropriately referenced in the following description of an exemplary drive pulse applied to an ink jet head during a nozzle recovery process according to the present invention.

As shown by the waveform in FIG. 12, line (2), the timing pulse Tp is a regular sequence of pulses t1 to tn having a period T and a prescribed pulse width Pw. Note that this timing pulse Tp is also used for ink jet head drive during a printing process.

The recovery ejection signal Pd shown at FIG. 12, line (1), is input to selector 150 and output to drive signal generator 180 at the nozzle recovery process. Based on this recovery ejection signal Pd, driver 190 applies a drive pulse as shown at FIG. 12, line (3), to ink jet head 30. Ink drops are thus ejected from all nozzles during the nozzle recovery process. Note that the recovery ejection signal Pd of this embodiment is output synchronized to the timing pulse Tp with one on pulse output every fourth timing pulse Tp.

Note that the drive voltage applied to the ink jet head is indicated by the amplitude (vertical axis) of the drive pulse shown in FIG. 12 (3).

The drive pulses f1, f2, f3, and f4 output at timing points t4, t8, t12, and t16 are drive pulses causing ink ejection from the nozzles. The drive voltage of those drive pulses therefore has the same amplitude VH as a drive pulse used for printing. The amplitude of drive pulses f11, f12, f13, f21, f22, f23, f31, f32, f33, f41, f42, and f43 output at the same period T as timing pulse Tp between ink ejection drive pulses is an amplitude VL lower than amplitude VH.

As a result of this drive method, the ink jet head is driven three times at drive pulse VL at the same period T as the timing pulse Tp, and the ink jet head is then driven once at drive voltage VH. This operating sequence, or recovery process unit, is repeated four times.

Driving the ink jet head with low amplitude drive pulses f11, f21, and f13 mobilizes ink inside the nozzles, thereby lowering the ink viscosity at the nozzle tip, and enabling efficient ink ejecting when drive pulse f1 is applied.

It should be noted that the exemplary embodiment of the present invention described above applies three low amplitude drive pulses followed by one high amplitude drive pulse in one recovery process unit, and repeats this recovery process unit four times. The invention shall not be so limited, however, as it will be obvious that various combinations of low and high amplitude drive pulses can be used according to the properties of the ink, the interval between nozzle recovery processes, and other factors.

Figure 13:
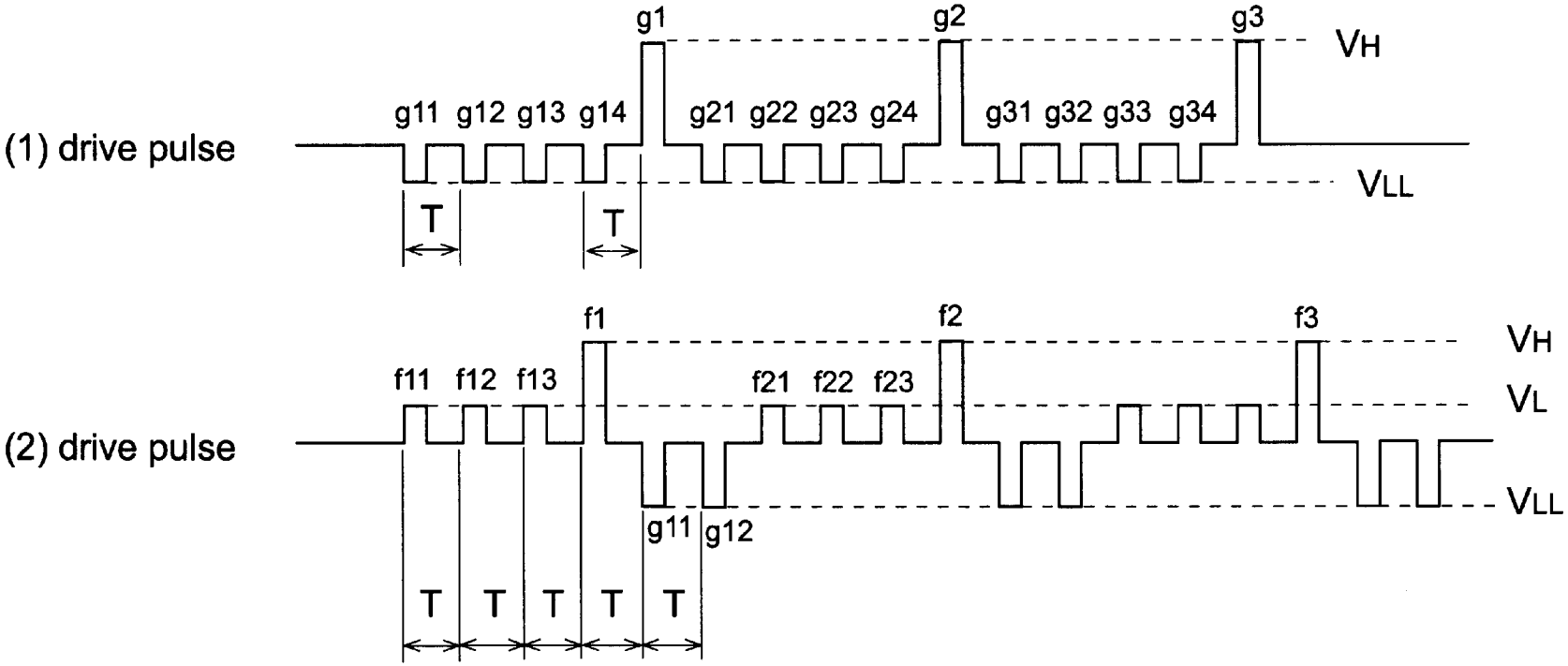
FIG. 13 is a timing chart of ink jet head operation during a nozzle recovery process in which a reverse polarity drive pulse is applied according to an alternative embodiment of an ink jet printer drive method according to the present invention.

An alternative embodiment of an exemplary drive pulse used for a nozzle recovery process according to the present invention is shown in FIG. 13 (1).

Before a drive pulse g1 of drive voltage VH for ejecting ink is applied, a drive pulse g11, g12, g13, and g14 of a drive voltage VLL having polarity different from that of drive pulse g1 is applied four times. This sequence constitutes one recovery process unit, which is repeated three times. Note that this drive wave can be achieved using a circuit as shown in FIG. 7 by setting the voltage V2 supplied to driver 190*b* higher than the voltage supplied to driver 190*a* so that VLL=V2−V1.

When an electrostatic actuator is used as the pressure generating means shown in FIG. 3, driving results in accumulation of a residual charge in the actuator. This causes a problem unique to an electrostatic actuator, that is, that the diaphragm may not return when the charge between the opposing electrodes is discharged, and the volume of the ink drops ejected from the nozzle then gradually decreases.

The method of the present invention, however, applies drive pulses g11 to g14 having polarity opposite that of the drive pulse g1. Applying these drive pulses g11 to g14 to drive the head can both mobilize ink in the nozzle to enable efficient ink ejecting when drive pulse f1 is applied, and reduce the residual charge accumulated in the electrostatic actuator.

A further alternative embodiment of an exemplary drive pulse used for a nozzle recovery process according to the present invention is shown in FIG. 13 (2).

In this example drive pulses f11, f12, and f13 of drive voltage VL are applied before drive pulse f1 of drive voltage VH is applied to eject ink. After drive pulse f1 is applied, reverse polarity drive pulses g11 and g12 of drive voltage VLL are applied to complete a recovery process unit, and this recovery process unit is repeated three times.

As this example illustrates, it is also possible to combine drive pulses f11 to f13 for mobilizing ink near the nozzles, with drive pulses gill and g12 for both mobilizing ink near the nozzles and reducing the residual charge accumulated in the electrostatic actuator.

APPLICATIONS IN INDUSTRY

An ink jet printer according to the present invention as described above can be used as an output terminal for a computer, a color printing apparatus, and a facsimile machine, and is particularly well suited as an ink jet recording apparatus for use in fields requiring a low operating cost and high reliability.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A drive method for an ink jet printer comprising a plurality of nozzles for ejecting ink drops, a plurality of pressure generators each disposed corresponding to a respective one of said plurality of nozzles for pressurizing ink in said nozzles, and a carriage for transporting said nozzles relative to a printing medium for printing, said drive method comprising the steps of:

generating a reference signal having a single frequency;

applying to each of said plurality of pressure generators in synchronism with the reference signal one of the following:

a first electric pulse having a first amplitude enabling ink drop ejecting, and a second electric pulse having a second amplitude lower than the first amplitude of the first electric pulse for mobilizing ink inside said nozzles;

performing a printing process whereby the first electric pulse is selectively applied to at least a select one of the plurality of pressure generators according to recording content; and performing a nozzle recovery process whereby the second electric pulse is applied to at least one of the plurality of pressure generators a plurality of times, and the first electric pulse is then applied to the at least one of the plurality of pressure generators, for preventing nozzle clogging.

2. The ink jet printer drive method according to claim 1, wherein said nozzle recovery process step of applying the second electric pulse to at least one of the plurality of pressure generators a plurality of times, and then applying the first electric pulse to the at least one of the plurality of pressure generators, is repeated at least two consecutive times.

3. The ink jet printer drive method according to claim 1, wherein the ink jet printer is a serial ink jet printer printing while moving the nozzles in a shift direction, and the nozzle recovery process step is executed at each printed line.

4. The ink jet printer drive method according to claim 1, wherein the nozzle recovery process step is executed after a print command is received and before the printing process based on the received print command.

5. The ink jet printer drive method according to claim 1, wherein each of the plurality of pressure generators comprises:

a diaphragm disposed in a part of an ink path in communication with a respective one of said plurality of nozzles; and an electrode opposing the diaphragm for electrostatically displacing the diaphragm by means of an applied electric pulse.

6. The ink jet printer drive method according to claim 5, wherein a first polarity of the first electric pulse is different from a second polarity of the second electric pulse.

7. The ink jet printer drive method according to claim 6, further comprising the steps of generating a third electric pulse having the second polarity; and applying at least one of the first second and third electric pulses to at least one of said plurality of pressure generators in synchronism with the reference signal.

8. The ink jet printer drive method according to claim 1 further comprising the steps of:

performing the printing process whereby the first electric pulse is selectively applied to at least a selected one of the plurality of pressure generators according to recording content to eject ink drops from at least a corresponding one of the plurality of nozzles for printing to a recording medium, and applying a second electric pulse to at least a non selected one of said plurality of nozzles.

9. The ink jet printer drive method according to claim 1, wherein the ink jet printer comprises a plurality of nozzles grouped according to color for ejecting ink drops in a plurality of colors.

10. An inkjet printer having a plurality of nozzles for ejecting ink drops, a plurality of pressure generators each disposed corresponding to a respective one of said plurality of nozzles for pressurizing ink in said nozzles, and a carriage for transporting said nozzles relative to a printing medium for printing, said inkjet printer comprising:

a reference signal generator for generating a reference signal having a single frequency;

a driver circuit for applying to each of said plurality of pressure generators in synchronism with the reference signal one of the following:

a first electric pulse having a first amplitude enabling ink drop ejecting, and a second electric pulse having a second amplitude lower than the first amplitude of the first electric pulse for mobilizing ink inside said nozzles; and a controller for controlling said driver circuit, said controller comprising;

means for performing a printing process whereby the first electric pulse is selectively applied to at least a select one of the plurality of pressure generators according to recording content; and means for performing a nozzle recovery process whereby the second electric pulse is applied to at least one of the plurality of pressure generators a plurality of times, and the first electric pulse is then applied to the at least one of the plurality of pressure generators, for preventing nozzle clogging.

11. The ink jet printer according to claim 10, wherein each of said plurality of pressure generators comprises:

a diaphragm disposed in a part of an ink path in communication with a respective one of said plurality of nozzles, and an electrode opposing said diaphragm for electrostatically displacing the diaphragm in accordance with said driver circuit.

12. The ink jet printer according to claim 11, wherein said driver circuit generates the first electric pulse having a first polarity different from a second polarity of the second electric pulse.

13. The ink jet printer according to claim 12, wherein said driver circuit generates a third electric pulse having the second polarity, and wherein said driver circuit applies at least one of the first, second, and third electric pulses to at least a selected one of said plurality of pressure generators in synchronism with the reference signal.

14. The ink jet printer according to claim 10, wherein said driver circuit selectively applies the first electric pulse to at least a selected one of said pressure generators according to recording content to eject ink drops from a respective one of said plurality of nozzles for printing to the recording medium, and wherein said driver circuit applies the second electric pulse to at least one of said plurality of nozzles other than the respective one of said plurality of nozzles to which the first electric pulse was applied by said driver circuit.

15. The ink jet printer according to claim 10, wherein said plurality of nozzles are grouped according to color for ejecting ink drops in a plurality of colors.

16. The ink jet printer according to claim 11, wherein each of said plurality of pressure generators comprises:

a common terminal connected in common to each of said plurality of pressure generators, and a plurality of segment terminals connected individually to a respective one of said plurality of pressure generators;

wherein said driver circuit comprises:

a first driver circuit for applying the first electric pulse having the first amplitude to said common terminal; and a second driver circuit for applying a third electric pulse having a third amplitude different from the first amplitude of the first electric pulse to a selected one of said plurality of segment terminals, wherein when said driver circuit applies the second electric pulse to each of said plurality of pressure generators said first driver circuit applies the first electric pulse to said common terminal and said second driver circuit applies the third electric pulse to the selected one of said plurality of segment terminals at substantially the same time.

17. An ink jet printer having a plurality of nozzles for ejecting ink drops, a plurality of pressure generators each disposed corresponding to a respective one of said plurality of nozzles for pressurizing ink in said nozzles, and a carriage for transporting said nozzles relative to a printing medium for printing, said inkjet printer comprising:

a reference signal generator for generating a reference signal having a single frequency;

a driver circuit for applying to each of said plurality of pressure generators in synchronism with the reference signal one of the following:

a first electric pulse having a first amplitude enabling ink drop ejecting, and a second electric pulse having a second amplitude lower than the first amplitude of the first electric pulse for mobilizing ink inside said nozzles; and a controller for controlling said driver circuit, said controller configured to perform a printing process whereby the first electric pulse is selectively applied to at least a select one of the plurality of pressure generators according to recording content; and performing a nozzle recovery process whereby the second electric pulse is applied to at least one of the plurality of pressure generators a plurality of times, and the first electric pulse is then applied to the at least one of the plurality of pressure generators, for preventing nozzle clogging.

18. The ink jet printer according to claim 17, wherein each of the plurality of pressure generators comprises:

a diaphragm disposed in a part of an ink path in communication with a respective one of said plurality of nozzles, and an electrode opposing the diaphragm for electrostatically displacing the diaphragm in accordance with said driver circuit.

19. The ink jet printer according to claim 18, wherein said driver circuit generates the first electric pulse having a first polarity different from a second polarity of the second electric pulse.

20. The ink jet printer according to claim 19, wherein said driver circuit generates a third electric pulse having the second polarity, and wherein said driver circuit applies at least one of the first, second, and third electric pulses to at least a selected one of said plurality of pressure generators in synchronism with the reference signal.

21. The ink jet printer according to claim 17, wherein said driver circuit selectively applies the first electric pulse to at least a selected one of the pressure generators according to recording content to eject ink drops from a respective one of the plurality of nozzles for printing to the printing medium, and wherein said driver circuit applies the second electric pulse to at least one of said plurality of nozzles other than the respective one of said plurality of nozzles to which the first electric pulse was applied by said driver circuit.

22. The ink jet printer according to claim 17, wherein said plurality of nozzles are grouped according to color for ejecting ink drops in a plurality of colors.

23. The ink jet printer according to claim 17, wherein each of said plurality of pressure generators comprises:

a common terminal connected in common to each of said plurality of pressure generators, and a plurality of segment terminals connected individually to a respective one of said plurality of pressure generators;

wherein said driver circuit comprises:

a first driver circuit for applying the first electric pulse having the first amplitude to said common terminal; and a second driver circuit for applying a third electric pulse having a third amplitude different from the first amplitude of the first electric pulse to a selected one of said plurality of segment terminals, wherein when said driver circuit applies the second electric pulse to each of said plurality of pressure generators said first driver circuit applies the first electric pulse to said common terminal and said second driver circuit applies the third electric pulse to the selected one of said plurality of segment terminals at substantially the same time.

* * * * *

UNITED STATES PATENT AND TRADEMARK OFFICE

CERTIFICATE OF CORRECTION

PATENT NO. : 6,174,038 B1
DATED : January 16, 2001
INVENTOR(S) : Chiyoshige Nakazawa et al.

It is certified that error appears in the above-identified patent and that said Letters Patent is hereby corrected as shown below:

Column 15,
Line 56, insert -- , -- after "first".

Column 17,
Line 1, change "claim 11" to -- claim 10 --.

Signed and Sealed this

Nineteenth Day of February, 2002

*Attest:*

*Attesting Officer*

JAMES E. ROGAN
*Director of the United States Patent and Trademark Office*